US005932303A

United States Patent [19]

Stern

[11] Patent Number: 5,932,303

[45] Date of Patent: Aug. 3, 1999

[54] BALANCING ORNAMENT

[76] Inventor: Marilyn Stern, 2336 California St. N.W., Washington, D.C. 20008

[21] Appl. No.: 08/853,904

[22] Filed: May 9, 1997

[51] Int. Cl.[6] ..... A63H 3/08

[52] U.S. Cl. ..... 428/16; 156/75; 446/325; 446/396

[58] Field of Search ..... 446/325, 396; 428/7, 16; 156/75

[56] References Cited

U.S. PATENT DOCUMENTS

| | | | |
|---|---|---|---|
| 502,896 | 8/1893 | Vine | 446/488 |
| 840,727 | 1/1907 | Whitehouse | 446/325 |
| 1,295,779 | 2/1919 | McLafferty | 446/325 |
| 1,547,967 | 7/1925 | Shilhan | 446/488 X |
| 2,398,471 | 4/1946 | Short et al. | 428/16 X |
| 2,544,594 | 3/1951 | Goldfarb | 446/74 |
| 2,580,241 | 12/1951 | Podmore | 446/488 |
| 3,183,622 | 5/1965 | Frankl | 446/329 |
| 3,518,785 | 7/1970 | Behr | 446/488 |
| 4,432,158 | 2/1984 | Nicholas | 446/325 |
| 5,545,447 | 8/1996 | De Mars | 428/16 |
| 5,714,212 | 2/1998 | Nissim et al. | 446/325 X |

FOREIGN PATENT DOCUMENTS

| | | | |
|---|---|---|---|
| 1639-700 | 4/1991 | U.S.S.R. | 446/488 |

*Primary Examiner*—Henry F. Epstein
*Attorney, Agent, or Firm*—Dickstein, Sharpiro, Morin & Oshinsky LLP

[57] ABSTRACT

An ornament is shaped to be in balance about a surface point that is adapted to engage an upstanding projection. In one preferred embodiment, the ornament is formed from paper and is in the shape of a bird. The surface point is located at the bird's beak. The beak is adapted to engage the drinking edge of a vessel such as a glass. The center of mass of the bird is located below the surface point so that the bird has a stable equilibrium. The bird has a flat tail positioned to face upward. The tail may be written on, making the bird suitable for use a place indicator on a table at a formal function.

31 Claims, 6 Drawing Sheets

FIG. 4
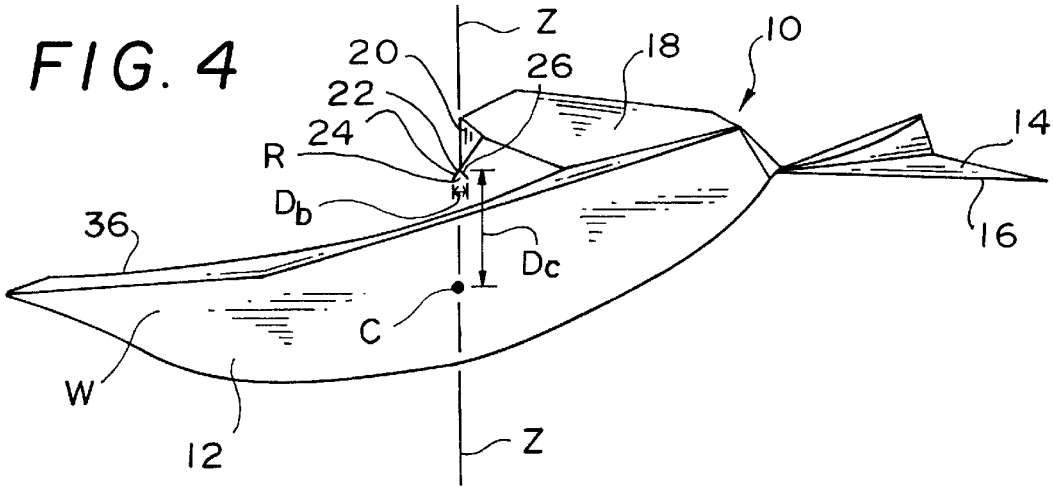
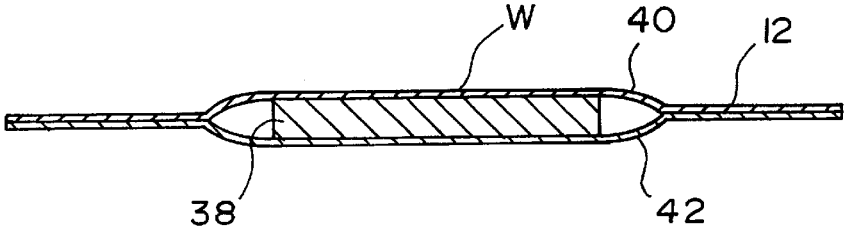
FIG. 5
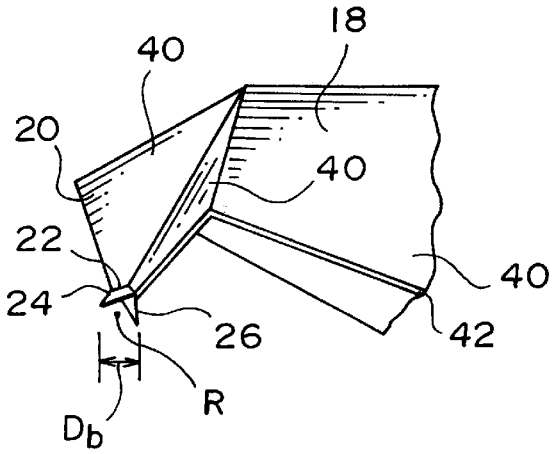
FIG. 6
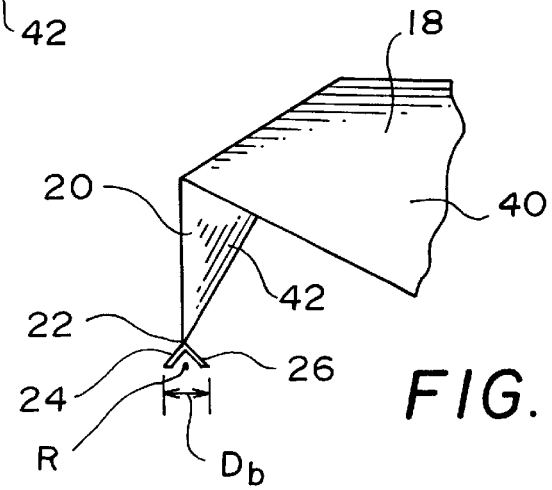
FIG. 7

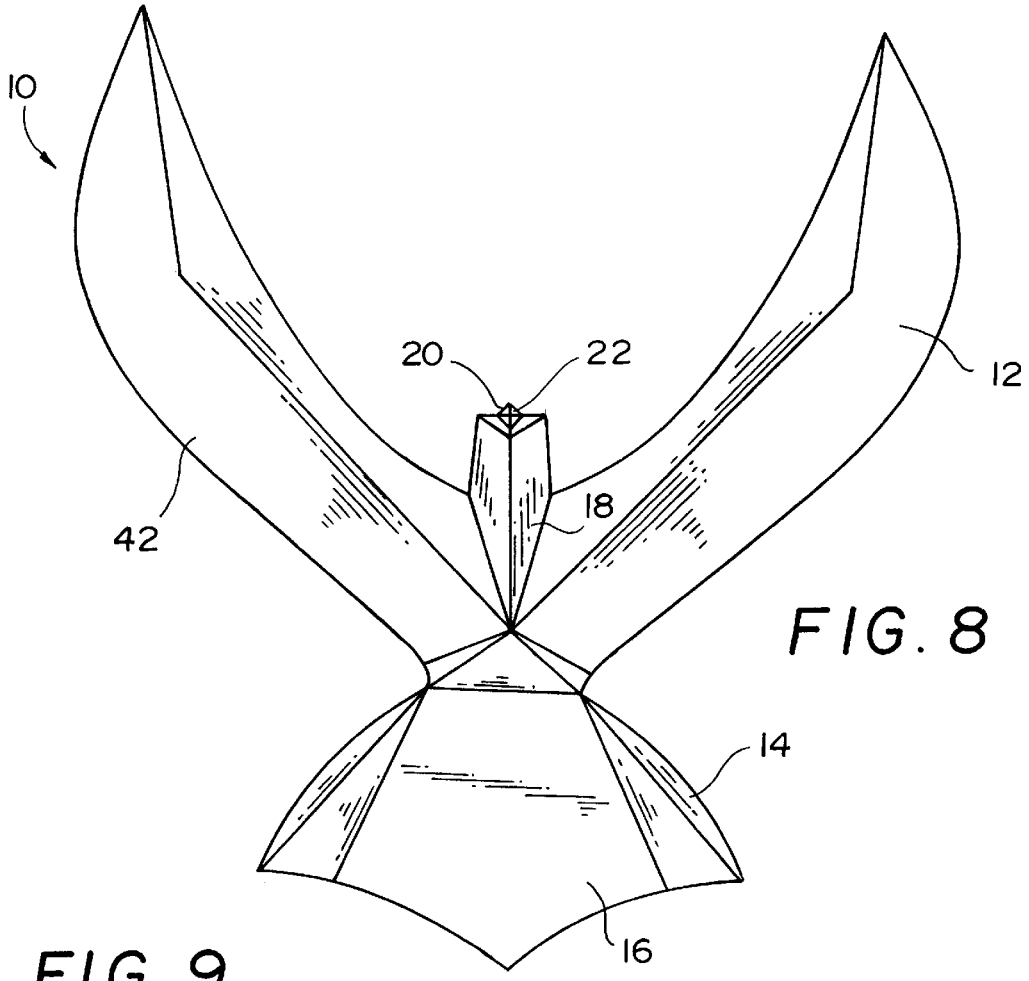
FIG. 8
FIG. 9
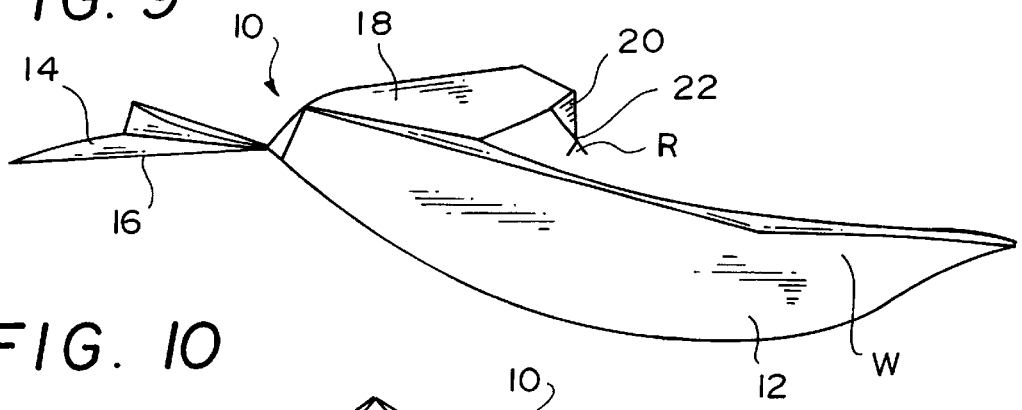
FIG. 10
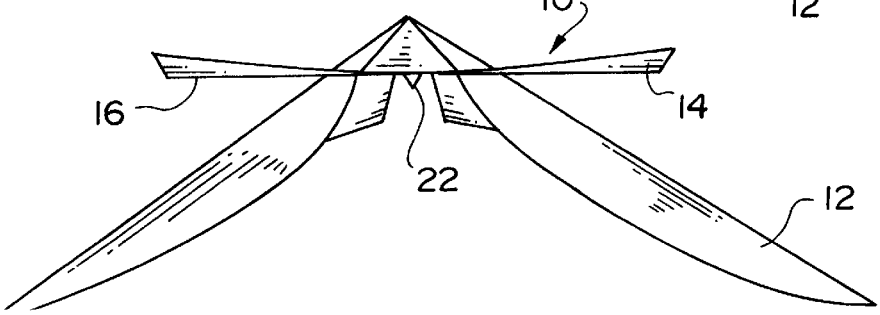

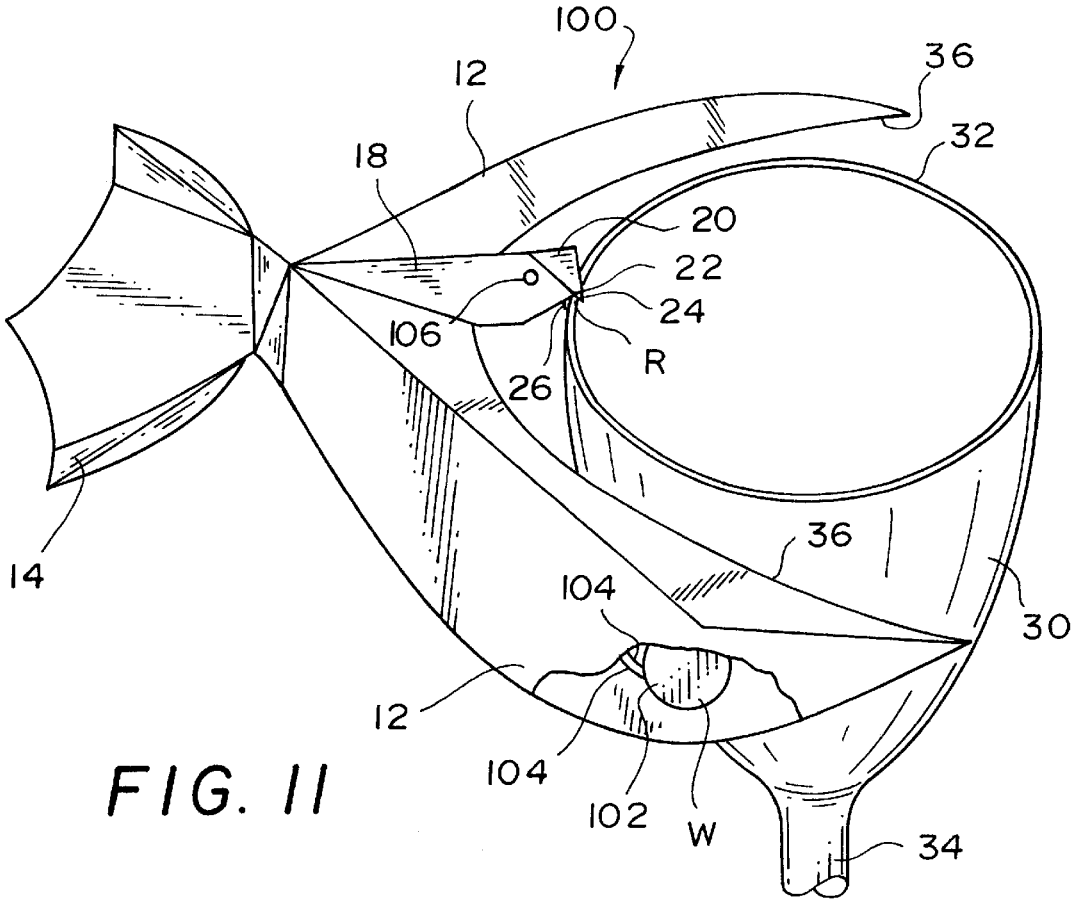
FIG. 11
FIG. 12
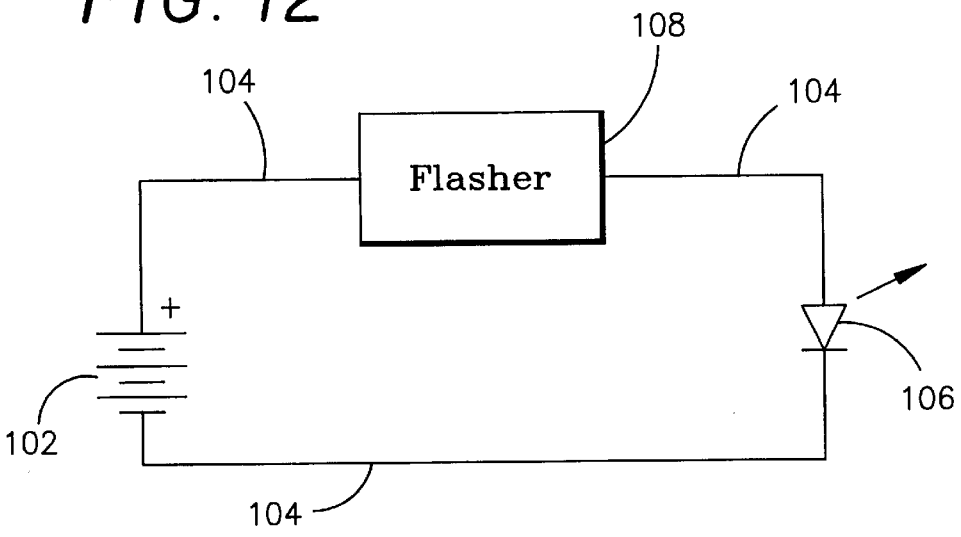

BALANCING ORNAMENT

BACKGROUND OF THE INVENTION

The present invention relates to field of novelty ornaments and more specifically to an ornament that can engage and be balanced on an upstanding edge.

Guests are assigned places for dining at many formal functions, such as weddings. In order to help guests find their seats, small cards with the guest's name imprinted thereon are often placed at their assigned place at the dining table. Such cards, while functional, are often not aesthetically pleasing, which is of concern to hosts of formal functions.

Ornaments in the shape of figures or abstract shapes are sometimes used instead of or in combination with place indicator cards to enhance aesthetic value. Place indicating cards may be attached to the ornament, or the guest's name may be written-directly onto the ornament. Simply placing an ornament on the table is one possible way to use it as a place indicator. A more unique approach may be desired, however. What is needed is an ornament that can be presented in an aesthetically pleasing manner.

SUMMARY OF INVENTION

The present invention provides an ornament that can be presented in an aesthetically pleasing manner by being balanced on an upstanding projection, such as the drinking edge of a vessel. The ornament is in balance about a point on the surface of the ornament body adapted to receive the upstanding projection.

In one aspect of the invention, the ornament is constructed such that its center of mass is below the point upon which the ornament is balanced. By constructing the ornament in this manner, a stable equilibrium is realized. Because the ornament has a stable equilibrium, it tends to return to its equilibrium point when disturbed, such as by a gust of wind.

In another aspect of the invention, the ornament is constructed of two layers of thin material, such as paper, that are glued together. This construction allows thin weights, used to affect the balance of the ornament, to be placed between the layers and remain hidden from view. The selective use of weights allows unbalanced and/or asymmetrical ornaments to be brought into balance about a desired body position, or balance point.

Another aspect of the invention is that the ornament is constructed with a flat body surface sufficiently large to allow the imprinting and display of names thereon. The flat body surface is sized and positioned so that a writing thereon can be easily read by a person observing the ornament from above or alongside.

In a preferred embodiment of the invention, the ornament is shaped like a bird in flight with its wings in a forward position and head facing the ground. It's beak is slightly open to form an inverted "V" or "U" cross sectional shape that is sized to accept the edge of a wine glass. The bird's sides are symmetrical; thus, the bird is balanced from side to side. The wings extend forward of the bird's head and are weighted such that the bird is balanced from front to back along an axis passing through the point of the bird's beak that accepts the rim of the wine glass. Thus, the bird's beak is a balance point. The bird's tail is substantially flat and large enough to allow a name to be printed on it. The bird described herein is simply one example of an ornament constructed according to the present invention. It will be readily appreciated that any number of subjects can be chosen.

An object of the invention is to provide an ornament that can be presented in an aesthetically pleasing manner, such as by being balanced on an upstanding edge of a glass.

Another object of the invention is to provide an ornament that can be used as a place indicator, as on a table.

A further object of the invention is to provide an ornament with a stable equilibrium point.

Another object of the invention is to provide an ornament that includes weights which may be concealed, to affect its balance.

These and other objects and advantages of the invention may best be understood with reference to the following detailed description of preferred embodiment of the invention, the appended claims and the several drawings attached hereto.

BRIEF DESCRIPTION OF THE DRAWINGS

FIG. 4 is a right side view of the ornament of FIG. 1;

FIG. 5 is a cross sectional view of a portion of a wing of the ornament of FIG. 1;

FIG. 6 is a perspective view of the head of the ornament of FIG. 1;

FIG. 7 is a side view of the head of the ornament of FIG. 1;

FIG. 8 is a bottom view of the ornament of FIG. 1;

FIG. 9 is a left side view of the ornament of FIG. 1;

FIG. 10 is a rear view of the ornament of FIG. 1;

FIG. 11 is a perspective view of an ornament constructed in accordance with a second embodiment of the present invention;

FIG. 12 is a circuit diagram of the ornament of FIG. 11; and

DETAILED DESCRIPTION OF PREFERRED EMBODIMENTS

Figure 1:
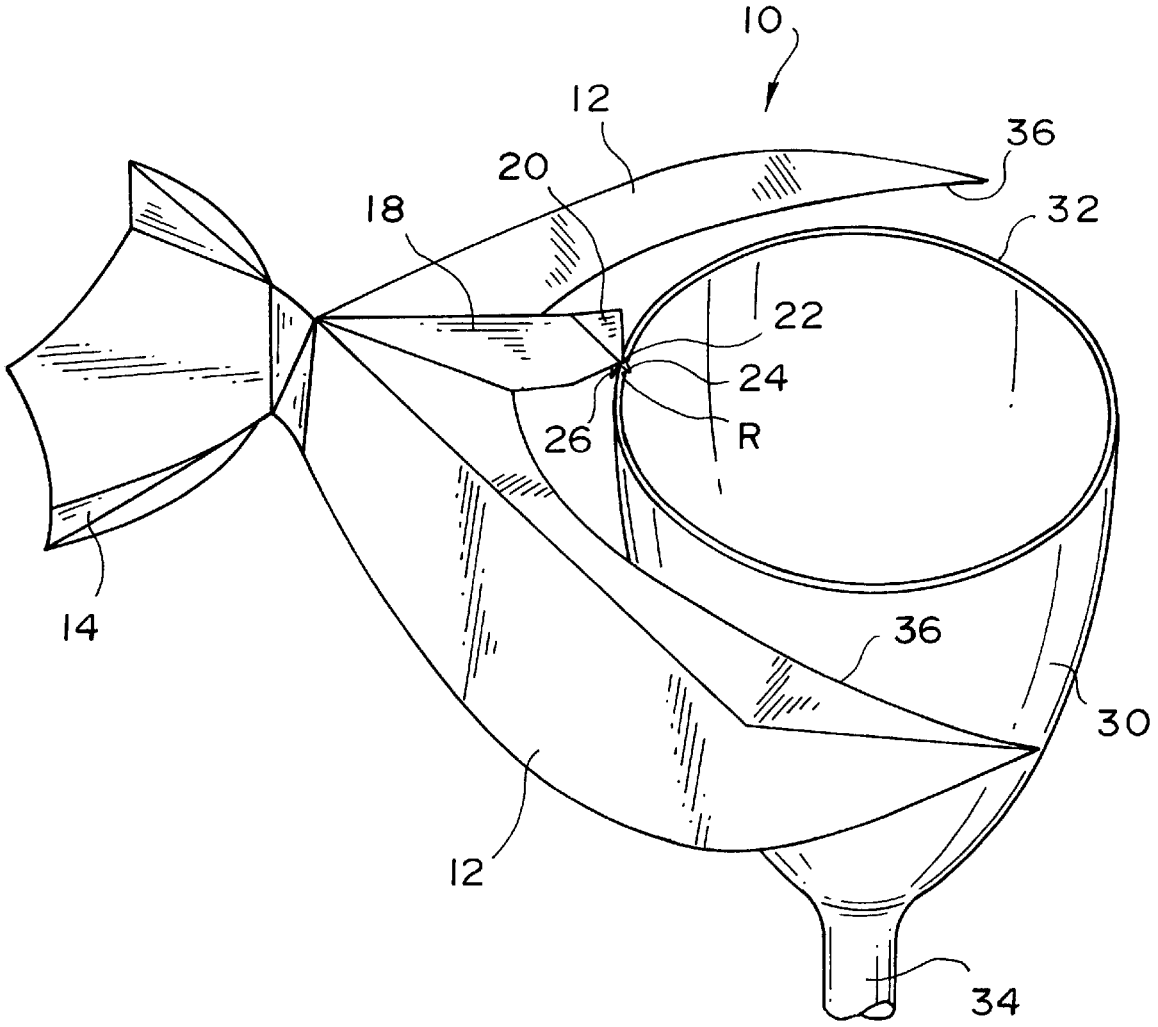
FIG. 1 is a perspective view of an ornament constructed in accordance with one embodiment of the present invention.

Referring now to the drawings, where like elements are designated by like reference numerals, there is shown in FIG. 1 an ornament in the shape of a bird 10. Although a bird is chosen as the subject, it should be appreciated that any number of animals, other figures, or abstract or geometric shapes can be chosen. The bird is balanced at a surface position R on the drinking edge 32 of a glass 30 supported by a stem 34. The bird 10 has wings 12, a tail 14, a body 18, and a head 20 with a beak 22. The bird 10 is constructed of two sheets of laminated paper that have been glued together and folded in the origami style. A single sheet of paper or sheets of other material, such as plastic, fiberglass, metal, glass, wood, plant material or micro-ply (a thin, lightweight plywood used by model makers) may also be used.

Figure 2:
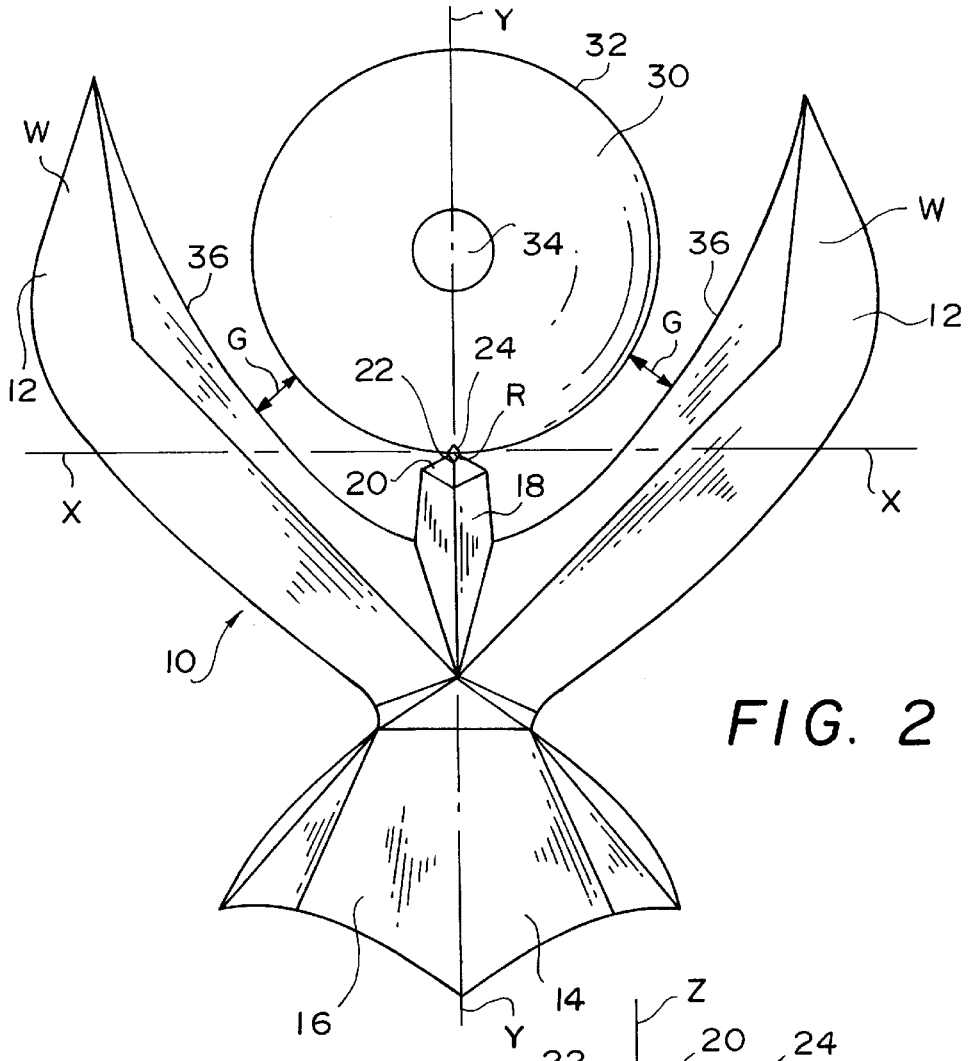
FIG. 2 is a top view of the ornament of FIG. 1.

Referring now to FIG. 2, the bird 10 is constructed such that it is symmetrical, and thus balanced, about the Y axis. Each wing 12 has an inside edge 36 that is contoured such that there is a minimum gap G between the inside edge 36 of the wing 12 and the edge 32 of the glass 30. The minimum gap G allows the bird 10 to rotate about the X and Y axes without its wings 12 coming into contact with the edge 32 of the glass 30.

The bird 10 is balanced about the X axis as well. In order to achieve balance about the X axis, it may be necessary to add weights 38 (FIG. 5) at a point W on the wings 12. A weight 38 is placed between the two pieces of paper 40, 42 used to construct the bird 10. The weights 38 are glued in place to prevent them from shifting and unbalancing the bird 10. The amount of added weight necessary is dependent upon the exact placement of the weights 38 in the wings 12, the weight of the pieces of paper 40, 42, and the amount of glue and laminate used to construct the bird 10. In the preferred embodiment shown, an equal weight is added to each wing at equal distances from the Y axis because the bird is symmetrical about the Y axis.

The tail 14 of the bird 10 has a flat body surface 16. The flat body surface 16 is positioned facing upward (FIG. 4) to allow easy viewing from above. The flat body surface 16 may have writing (not shown) imprinted thereon, such as the name of a guest if the bird 10 is to be used as a place indicator at a formal function. The flat body surface 16 may be coated such that names imprinted thereon may be erased at a later time. Although bird 10 has been provided with a flat body surface 16 for imprinting, other shapes may be chosen such that is not possible or desirable to provide such a surface. In this case, a separate card (not shown) on which a guest's name may be printed may be attached to the body of an ornament, preferably in a position from which it can be viewed from above or alongside the ornament. Alternately, names may be formed of other materials, such as wire bent in the shape of letters, and attached to the body of the ornament.

Figure 3:
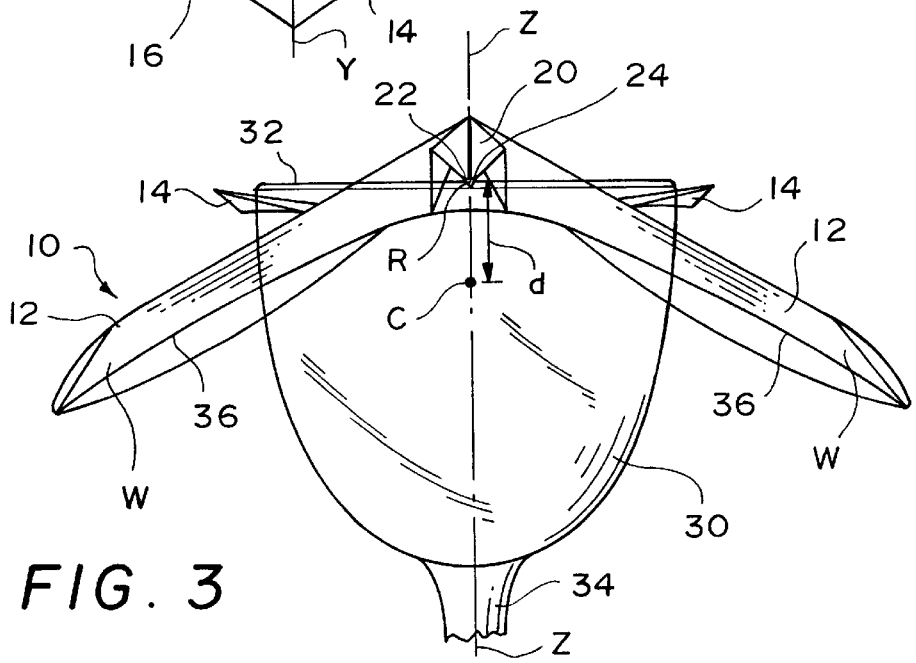
FIG. 3 is a front view of the ornament of FIG. 1.

The Z axis (FIG. 3) shares a common origin R with the X and Y axes to form an orthogonal three dimensional coordinate system. The common origin R is at the point in space where the beak 22 of the bird 10 rests upon the edge 32 of the glass 30, and about which the bird 10 is balanced. The center of mass C is located at a distance D below the origin R along the Z axis. The location of the center of mass C below the origin R results in a stable equilibrium. Thus, the bird 10 tends to return to its original position when disturbed. If the center of mass C were located above the balance point R, the equilibrium would be unstable, and any small disturbance would flip the bird.

Referring now to FIGS. 6 and 7, the head 20 of the bird 10 has a beak 22. The beak 22 is formed of an upper section 24 and a lower section 26. The upper and lower sections 24, 26 are formed by separating the top piece of paper 40 from the bottom piece of paper 42. The top and bottom pieces of paper 40, 42 are creased and folded away from each other to form an inverted 'V' or 'U' shaped opening such that the bottom tips of the upper and lower sections 24, 26 of the beak 22 are a distance Db apart. The distance Db is chosen to be wider than the thickness of the glass 30 at its edge 32. This construction allows the bird 10 to be balanced on its beak 22 at the edge 32 of the glass 30.

Figure 13:
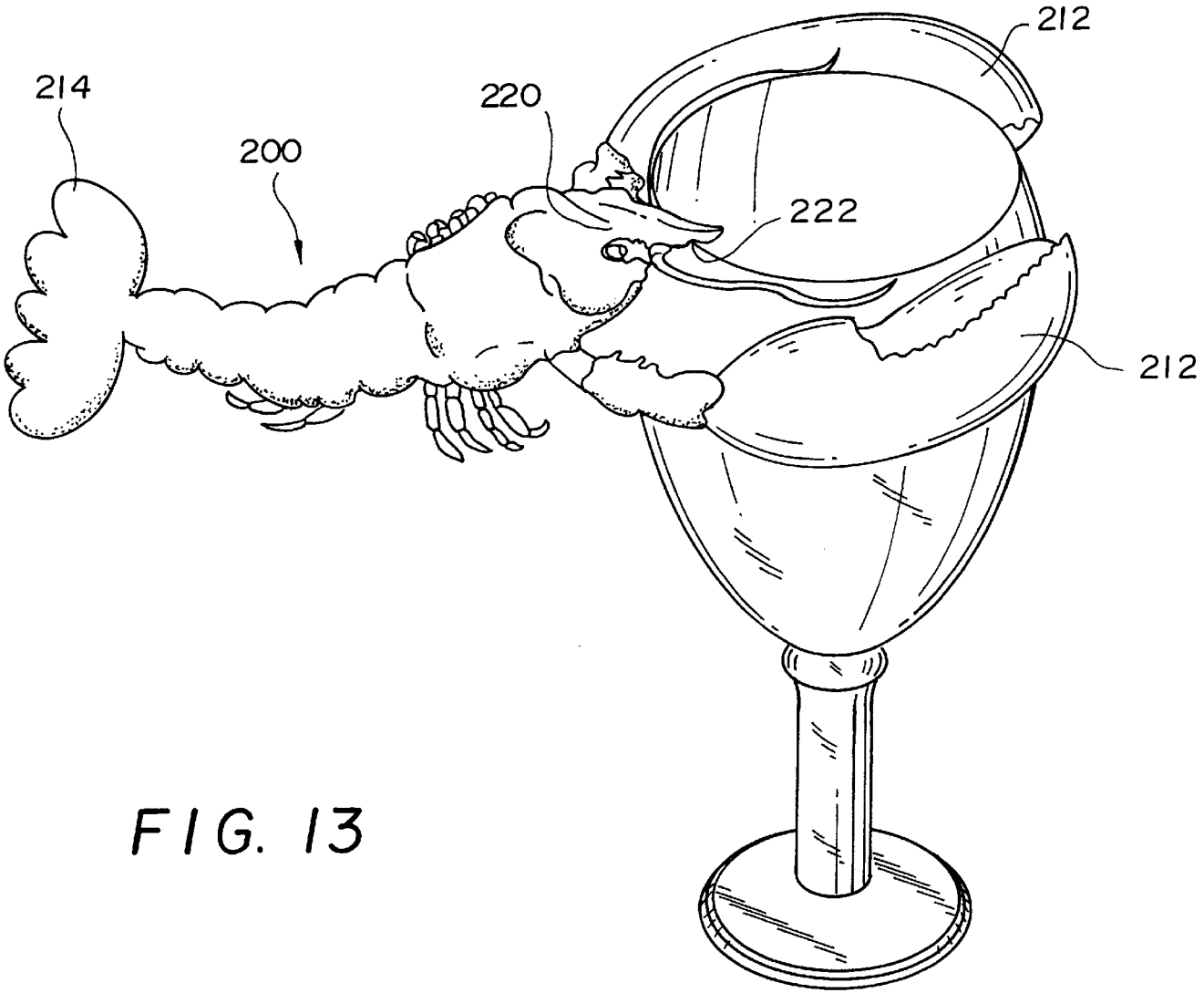
FIG. 13 is a perspective view of an ornament constructed in accordance with a third embodiment of the present invention.

It will be readily appreciated by those skilled in the art that the balance point may be located in different surface positions on the body of the ornament. If a bird is used as the subject, the balance point may be located at its feet rather than its beak. Other subjects will necessarily have balance points in different surface positions on the body of the ornament. For example, an ornament in the shape of a lobster may be desired. Such an embodiment is shown in FIG. 13. The lobster 200 has claws 212 that extend forward of the head 220 of the lobster 200 in roughly the same orientation as the bird's 10 wings 12. The lobster 200 has a tail 214 positioned similarly to the tail 14 of the bird 10. The balance point is located at the mouth 222 of the lobster 200.

It will also be appreciated by those skilled in the art that any number of variations to the shape of the ornament could be made. For example, the illustrated embodiment is symmetrical about one axis. It is equally possible to construct ornaments symmetrical about two or all three axes, or ornaments that are completely asymmetrical. Completely asymmetrical ornaments may be desirable for providing a surprisingly balanced ornament that appears to be unbalanced. One method that may be used to accomplish this result is to provide an ornament composed of a single curvilinear element that appears to be symmetrical about one axis except for two spheres of different sizes at the ends of the element. The smaller sphere may be constructed of a relatively lighter material as compared to the larger sphere such that the two spheres are of equal weight despite their difference size, thus bringing the ornament into balance.

Different weight distributions may also be used to bring an unbalanced, asymmetrical ornament into balance. In the illustrated embodiment, thin weights are added between sheets of paper to conceal them. If a single sheet of paper is used to form the ornament, and it is necessary to add weights to balance the ornament, the weights may be attached to the ornament at a point that is not in sight when the ornament is displayed. The weights may also be placed in visible locations, where they may also be painted and used as decorative elements. Also, it is possible to form an ornament which requires no weight for balancing.

It is also possible to provide ornaments with lights. Watch batteries may be used in place of weights in such an embodiment. FIG. 11 depicts a bird ornament 100 that is identical to the bird ornament of FIG. 1 except that a watch battery 102 has been added in place of the weight 38 in each of the wings 12 at point W. Two wires 104, hidden between the sheets of paper 40, 42 connect the battery to a small LED 106 (or other illuminating device) in the bird's 100 head 20. As shown in FIG. 12, a flasher 108 may be included to make the lights 106 blink.

The above description and drawings are only illustrative of preferred embodiments which can achieve and provide the objects, features and advantages of the present invention. It is not intended that the invention be limited to the embodiment shown and described in detail herein. Modifications coming within the spirit and scope of the following claims are to be considered part of the invention.

What is claimed as new and desired to be protected by Letters Patent of the United States is:

1. An ornament that is balanceable on an upstanding rim of a container, the ornament comprising:

an ornament body having body surfaces, the ornament body having a surface position at which the ornament is in balance; and a projection engaging area having an inverted V or U cross sectional shape formed at the surface position, whereby the projection engaging area is adapted to engage the upstanding rim so that the ornament is engageable with and balanceable on the upstanding rim; and wherein the ornament body is adapted such that no part of the ornament body other than the projection engaging area comes into contact with any part of the container when the ornament is balanced on the upstanding rim.

2. The ornament of claim 1 wherein the ornament has a center of mass, and the center of mass is positioned below the surface position.

3. The ornament of claim 1 wherein the ornament is constructed of two sheets of material, each sheet of material has top and bottom surfaces, and the top surface of one sheet of material is fastened to the bottom surface of the other sheet of material.

4. The ornament of claim 3 wherein the two sheets of material are folded to form the ornament.

5. The ornament of claim 4 wherein the material is selected from the group consisting of paper, plastic, fiberglass, metal, glass, wood, micro-ply and cardboard.

6. The ornament of claim 3 wherein the surface position is at an edge of the ornament, and the projection engaging area is formed by separating the two pieces of material at the surface position.

7. The ornament of claim 3 wherein a weight is added between the two sheets of material to produce balancing of the ornament at the projection engaging area.

8. The ornament of claim 1 wherein the ornament has a flat body surface positioned such that the flat body surface faces upward when the ornament is balanced on an upstanding projection.

9. The ornament of claim 8 wherein the flat body surface is sized such that it may contain a visually perceptible writing thereon.

10. The ornament of claim 1, wherein the container is a drinking glass.

11. A method of displaying an ornament comprising:

providing a container, the container comprising an upstanding rim;

providing a balancing ornament comprising:

an ornament body having body surfaces, the ornament body having a surface position at which the ornament is in balance; and a projection engaging area at the surface position, the projection engaging area having an inverted V or U cross sectional shape and being adapted to engage the upstanding rim so that the ornament is engageable with and balanceable on the upstanding rim;

wherein the ornament body is adapted such that no part of the ornament body other than the projection engaging area comes into contact with any part of the container when the ornament is balanced on the upstanding rim; and balancing the ornament on the upstanding rim.

12. The method of claim 11, wherein the ornament has a center of mass, and the center of mass is positioned below the surface position.

13. The method of claim 12, wherein the ornament is constructed of two sheets of material, each sheet of material has top and bottom surfaces, and the top surface of one sheet of material is fastened to the bottom surface of the other sheet of material.

14. The method of claim 13, wherein the two sheets of material are folded to form the ornament.

15. The method of claim 14, wherein the material is selected from the group consisting of paper, plastic, fiberglass, metal, glass, wood, micro-ply and cardboard.

16. The method of claim 13, wherein the surface position is at an edge of the ornament, and the projection engaging area is formed and adapted to engage the projection by a separation of the two pieces of material at the surface position.

17. The method of claim 13, wherein a weight is added between the two sheets of material to produce balancing of the ornament at the projection engaging area.

18. The method of claim 11 wherein the ornament has a flat body surface positioned such that the flat body surface faces upward when the ornament is balanced on an upstanding projection.

19. The method of claim 18 further comprising providing a writing on the flat body surface.

20. The method of claim 11, wherein the container is a drinking glass.

21. A table place indicator comprising an ornament having a body, the body having surfaces, the body having a surface position at which the ornament is in balance, the surface position having an inverted V or U cross sectional shape and being adapted to engage with an upstanding rim of a container whereby the ornament balances on the rim, the body having a center of mass, the center of mass being positioned below the surface position, and the body being adapted such that no part of the ornament body other than the projection engaging area comes into contact with any part of the container when the ornament is balanced on the upstanding rim.

22. The ornament of claim 21 wherein the body has a flat body surface positioned to face upward, and the flat surface being of a size sufficient to receive visually perceptible printing thereon.

23. The table place indicator of claim 21 further comprising a card attached to the body of the ornament and positioned to face upward and being of a size sufficient to receive a visually perceptible writing thereon.

24. The table place indicator of claim 21, wherein the ornament is formed of two pieces of paper, each paper has a top surface and a bottom surface, the top surface of one piece of paper is fastened to the bottom surface of the other piece of paper, and the surface position is adapted to engage the edge of the container by a separation of the two pieces of paper at the body position, the separation forming an edge engaging area.

25. The table place indicator of claim 21 wherein the ornament is in the shape of an animal.

26. The table place indicator of claim 21 wherein the ornament is in the shape of a bird, the bird has a beak, the surface position is located at the beak, the bird has a tail, and the tail forms the flat body surface.

27. The table place indicator of claim 21 wherein the ornament is in the shape of a lobster, the lobster has a head with a mouth, the surface position is located at the mouth, the lobster has a tail, the tail forms the flat body surface, the lobster has claws, and the claws extend forward of the head.

28. The table place indicator of claim 21, further comprising at least one light emitting device and at least one battery, the battery being in electrical connection with the light emitting device.

29. The table place indicator of claim 28, further comprising a flasher in electrical connection with the battery and the light emitting device such that the flasher causes the light emitting device to blink.

30. The table place indicator of claim 28 wherein the light emitting device is a light emitting diode.

31. A table place indicator comprising:

a container having an upstanding curved rim;

an ornament having a body, the ornament body having body surfaces, the ornament body having a surface position at which the ornament is in balance, the ornament having a projection engaging area having an inverted V or U cross sectional shape formed at the surface position, the projection engaging area being adapted to engage the rim; and the ornament body having a substantially flat surface sized and positioned such that a writing thereon can be easily read from above when the ornament is balanced on the rim;

wherein the ornament body is adapted such that no part of the ornament body is in contact with the container when ornament is balanced on the rim.

* * * * *